US005299422A

United States Patent [19]

Nakagawa et al.

[11] Patent Number: 5,299,422

[45] Date of Patent: Apr. 5, 1994

[54] ENERGY CONVERTER

[75] Inventors: Katsumi Nakagawa, Tsuchiura; Koji Nishida, Anjo; Yasuo Kuwabara, Nagoya, all of Japan

[73] Assignee: Aisin Seiki Kabushiki Kaisha, Kariya, Japan

[21] Appl. No.: 917,964

[22] Filed: Jul. 24, 1992

[30] Foreign Application Priority Data

Jul. 26, 1991 [JP] Japan ..... 3-187781
Dec. 26, 1991 [JP] Japan ..... 3-345030

[51] Int. Cl.[5] ..... F15B 21/12
[52] U.S. Cl. ..... 60/532; 91/DIG. 1
[58] Field of Search ..... 60/532, 519; 416/6, 416/223 R; 91/DIG. 1, DIG. 4, 1; 92/5 R

[56] References Cited

U.S. PATENT DOCUMENTS

| | | | |
|---|---|---|---|
| 2,181,120 | 11/1939 | Dake | 60/532 |
| 2,608,623 | 8/1952 | Cutler et al. | 60/532 |
| 2,616,984 | 11/1952 | Pare | 91/DIG. 4 |
| 3,027,876 | 4/1962 | Strick | 91/DIG. 4 |
| 3,511,050 | 5/1970 | Taberner | 60/532 |
| 5,145,333 | 9/1992 | Smith | 416/223 R X |

FOREIGN PATENT DOCUMENTS

| | | | |
|---|---|---|---|
| 2-41677 | 2/1990 | Japan . | |
| 0695722 | 11/1979 | U.S.S.R. | 60/532 |
| 1100435 | 6/1984 | U.S.S.R. | 416/223 R |

OTHER PUBLICATIONS

Holzer et al., "On the Theory of Acoustic Radiation Force and its Application in Ultrasonic Power Measurements", Institute of Biomedical Engineering, Technical University, Graz. Inffeldgasse 18, A-8010 Graz, Acustica, vol. 49, 1981, pp. 55-63.

K. Beissner, "On the Time-Average Acoustic Pressure", Acustica, vol. 57, Jan. 1985, pp. 1-4.

*Primary Examiner*—Edward K. Look
*Assistant Examiner*—Hoang Nguyen
*Attorney, Agent, or Firm*—Burns, Doane, Swecker & Mathis

[57] ABSTRACT

An energy converter includes a resonator adapted for generating a sound wave in a medium, and a movable member disposed in a progressive direction of the sound wave generated by the resonator, and adapted for being driven by an acoustic radiation pressure resulting from the progression of the sound wave. Since the vibrational energy of the resonator is conveyed to the movable member as the acoustic radiation pressure by way of the medium, the present energy converter exhibits an excellent energy conversion efficiency. Namely, the loss is reduced during the conversion of the vibration of the resonator into the driving force for the movable member, and accordingly the present energy converter exhibits a high conversion efficiency. The present energy converter may further include a stator adapted for holding the stator thereto and disposing the liquid therein. If such is the case, the energy converter can be applied to liquid media.

26 Claims, 6 Drawing Sheets

ENERGY CONVERTER

BACKGROUND OF THE INVENTION

Field of the Invention

The present invention relates to an energy converter. For instance, it is applicable to an actuator which is operated with a sound wave as a driving source. More precisely, it is applicable to an actuator in which an acoustic radiation pressure is utilized in order to carry out a rotary motion, a linear motion, or the like.

SUMMARY OF THE INVENTION

The inventors of the present invention have developed a novel engineering principle in which an acoustic radiation pressure is utilized as a driving source for driving a movable member. In accordance with the novel principle, the present inventors have invented a novel energy converter. For instance, the present novel energy converter is characterized by the following advantageous effects: It is superior in quietness, and it can be used in liquid media. In addition, in accordance with the novel engineering principle, the present novel energy converter can be made into configurations which have not been formed so far, and it can be put into applications which have not been available so far.

It is therefore a primary object of the present invention to provide the novel energy converter based on the novel engineering principle in which an acoustic radiation pressure is utilized as a driving source for driving a movable member. It is a further object of the present invention to upgrade the productivity in the manufacture of the energy converter.

An energy converter according to the present invention comprises:

a resonator adapted for generating a sound wave in a medium; and a movable member disposed in a progressive direction of the sound wave generated by the resonator, and adapted for being driven by an acoustic radiation pressure resulting from the progression of the sound wave.

Thus, in the present energy converter, the resonator generates the sound wave in the medium. The sound wave propagates in the medium, and it collides with the movable member. The movable member receives the acoustic radiation pressure resulting from the progression of the sound wave. Consequently, the movable member receives a force in the progressive direction of the sound wave, and thereby it is driven. Hence, with the arrangement, the vibrational energy of the resonator is conveyed to the movable member as the acoustic radiation pressure by way of the medium.

Further, in the present energy converter, the movable member may include an inclining surface inclining by 45 degrees with respect to the progressive direction of the sound wave, and the present energy converter may further comprise a reflector which is adapted for further reflecting the sound wave reflected from the inclining surface of the movable member. With these extra constituent elements, part of the sound wave energy generated by the resonator is absorbed by the inclining surface, and it drives the movable member. On the other hand, the sound wave reflected from the inclining surface is again reflected to the inclining surface by the reflector, and it further gives energy to the inclining surface. As a result, the force is increased, force which acts in the direction from the resonator to the movable member. Hence, with the arrangement, the reflected sound wave can be used also to drive the movable member, and accordingly the present energy converter comes to exhibit a more excellent energy conversion efficiency.

Furthermore, in the present energy converter, the movable member may be a rotor which includes a blade made of a sound wave reflectible material and disposed in the progressive direction of the sound wave, and the present energy converter may further comprises a stator to which the resonator is fixed, the stator including a side wall disposed in the progressive direction of the sound wave generated by the resonator. Here, the side wall is adapted for reflecting the sound wave in a direction facilitating a rotation of the rotor. With these extra constituent elements, part of the sound wave energy generated by the resonator is absorbed by the blade, and it rotates the movable member. On the other hand, the sound wave which passes over or misses the blade is again reflected to the blade by the side wall in the direction facilitating the rotation of the rotor, and it further gives energy to the blade in the direction rotating the rotor. As a result, the force is increased, force which acts in the direction from the resonator to the movable member. Hence, with the arrangement, the sound wave which passes over or misses the blade can be used also to rotate the rotor, and accordingly the present energy converter comes to exhibit a more excellent energy conversion efficiency.

Moreover, in the present energy converter, the movable member may be a rotor which includes a means disposed in the progressive direction of the sound wave and adapted for receiving the acoustic radiation pressure, and the present energy converter may further comprise the resonator which is adapted for rotating the rotor in a clockwise direction in a quantity of one at least and the resonator which is adapted for rotating the rotor in a counterclockwise direction in a quantity of one at least. With these extra constituent elements, the rotor can be rotated either in the clockwise direction or in the counterclockwise direction by selectively operating (i.e., vibrating) the resonators. Hence, with the arrangement, the present energy converter can be made into a rotary actuator which can rotate in the clockwise direction and the counter clockwise direction.

In addition, in a certain application, the present energy converter comprises:

a stator;

a resonator held to the stator, and adapted for generating a sound wave;

a medium disposed in the stator, and adapted for generating a sound field with the sound wave generated by the resonator; and a movable member disposed in a progressive direction of the sound wave generated by the resonator in the stator, and adapted for being driven by an acoustic radiation pressure resulting from the progression of the sound wave in the sound field generated by the medium.

This latter present energy converter operates as follows. The movable member is driven by the acoustic radiation pressure. The acoustic radiation pressure results from the progression of the sound wave, which is generated by the vibrating resonator, in the sound field, which is generated by the medium with the sound wave.

Moreover, in designing the latter present energy converter as well as the former one, a greater designing freedom can be enjoyed fully in the layout arrangement of the movable member or the like.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

Figure 1:
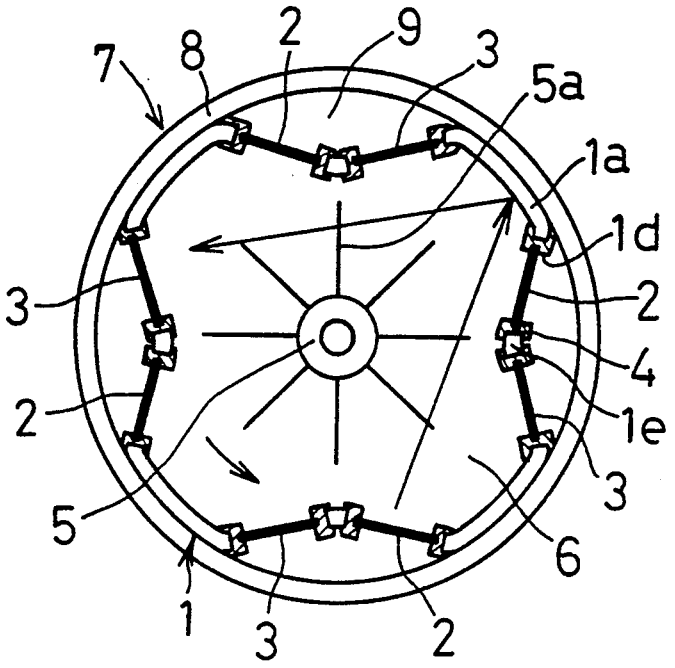
FIG. 1 a plan view of an energy converter of a First Preferred Embodiment according to the present invention.
Figure 2:
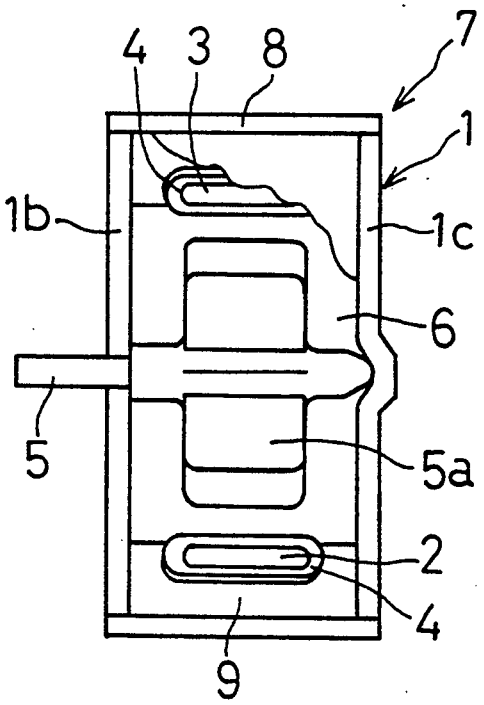
FIG. 2 is a side view of the energy converter illustrated in FIG. 2.

The energy converters of the preferred embodiments according to the present invention will be hereinafter described with reference to the accompanying drawings. FIGS. 1 and 2 illustrate the energy converter of the First Preferred Embodiment which is designated at 7. The energy converter 7 is an actuator in which the vibrations of the resonators 2 and 3 are converted into the rotary motions of a rotor 5.

As illustrated in FIGS. 1 and 2, a housing 1 includes a plurality of side walls 1*a* which are formed in a cylindrical shape, and a top cover 1*b* and a bottom cover 1*c* which are fixed closely to the side walls 1*a* so as to enclose the top and the bottom portions of the side walls 1*a*, respectively. Further, a plurality of windows 1*d* is formed between the side walls 1*a*, and there is provided a pillar 1*e* which is disposed in each of the windows 1*d*. Furthermore, in each of the windows 1*d*, there is provided the resonator 2 which is adapted for rotating the rotor 5 in the counterclockwise direction, and the resonator 3 which is adapted for rotating the rotor 5 in the clockwise direction. The resonators 2 and 3 are held to the side walls 1*a* and the pillars 1*e* by way of rubber bushings 4 so that they are sealed to each other and so that they can vibrate. Moreover, in the housing 1, the rotor 5 is held rotatably to the top and the bottom covers 1*b* and 1*c*. The rotor 5 includes a plurality of blades 5*a* which are made of an ultrasonic wave reflectible material and which are disposed radially. These blades 5 are disposed in the progressive directions of the sound waves which are generated by the resonators 2 and 3. In addition, a liquid is filled in the housing 1.

The energy converter 7 thus constructed can be used in the same liquid as the liquid 6 which is filled in the housing 1. If such is the case, the energy converter 7 is accommodated in a sealing case 8. With the sealing case 8, there is formed a plurality of air chambers 9 between the portions of the sealing case 8 facing the liquid 6 (or the portions of the sealing case 8 facing the windows 1*d*) and the resonators 2 and 3. Namely, the resonators 2 and 3 interpose between the liquid 6 and the portions of the sealing case 8. These air chambers 9 are provided in order to effectively propagate the sound waves, which are generated by the vibrations of the resonators 2 and 3, forward to the blades 5*a* and the side walls 1*a* in the liquid 6 filled in the housing 1. Here, the sealing case 8 is required only when the energy converter 7 is used in liquid media. However, the sealing case 8 is not needed in particular when the energy converter 7 is used in atmosphere. If such is the case, the housing 1 requires a close sealing construction in order to completely enclose the liquid 6 therein.

The operation of the energy converter 7 will be hereinafter described. When the resonators 2 are operated to generate the sound waves, the liquid 6 generates the sound field with the sound waves in the housing 1 accordingly. As a result, the blades 5*a* of the rotor 5, which are disposed in the progressive directions of the sound waves, receive the acoustic radiation pressures resulting from the progressions of the sound waves in the sound field generated by the liquid 6. Additionally, the sound waves which pass over or miss the blades 5*a* are reflected by the side walls 1*a*, and they are directed to other blades 5*a* which are different from the aforementioned blades 5*a*. Consequently, the other blades 5*a* receive the acoustic radiation pressures resulting from the progressions of the reflected sound waves in the sound field generated by the liquid 6. As a result, the rotor 5 is rotated in the counterclockwise direction in FIG. 1. On the other hand, when the resonators 3 are operated to generate the sound waves, the rotor 5 is rotated in the direction opposite to the aforementioned direction, i.e., in the clockwise direction in FIG. 1.

Here, the acoustic radiation pressure means a force which acts on a surface of a body when a sound wave collides with the surface of the body and when it is absorbed therein or reflected therefrom. The acoustic radiation pressure is sometimes referred to as the Langevin's radiation pressure, and it arises in the following directions, e.g., in the progressive, the reflection, the transmittance, the absorption and the flexure directions of the sound waves generated by the resonators 2 and 3.

A force "F" resulting from an acoustic radiation pressure depends on a sound-energy flux density "E" of a sound wave, a sound wave receiving area "S" and a reflection coefficient "R," and it can be expressed by the following equation:

$$F=S\times E\times(1+R).$$

Further, the reflection coefficient "R" depends on specific acoustic impedances "$Z_1$" and "$Z_2$" of the blades 5a and the liquid 6, and it can be expressed by the following equation:

$$R=\{(Z_2-Z_1)/(Z_2+Z_1)\}^2.$$

Namely, it is possible to efficiently obtain the force "F" resulting from the acoustic radiation pressure by appropriately selecting the materials which exhibit effective specific acoustic impedances for constituting the blades 5a and the liquid 6.

In the energy converter of the First Preferred Embodiment, i.e., the energy converter 7, stainless steel was used for the material constituting the blades 5a, and water was used for the material constituting the liquid 6. With this selection of the materials, the reflection coefficient "R" was 90% approximately. In addition, a reflected sound wave can be obtained effectively by appropriately selecting materials having effective specific acoustic impedances for constituting the housing 1 and the liquid 6. In that way, the reflected sound wave can be applied to the blades 5a effectively and the acoustic radiation pressure can be obtained more efficiently. For example, aluminum or stainless steel can be used also for the material constituting the housing 1, and alcohol or kerosene can be used also for the material constituting the liquid 6.

Further, in the energy converter 7, a disk-shaped piezo-electric element was used for the resonators 2 and 3. The disk-shaped piezo-electric element was made of PZT (i.e., lead zirconate titanate), it had a thickness of 0.8 mm and a diameter of 20 mm, and it exhibited a longitudinal resonance frequency of 2.4 MHz.

Figure 7:
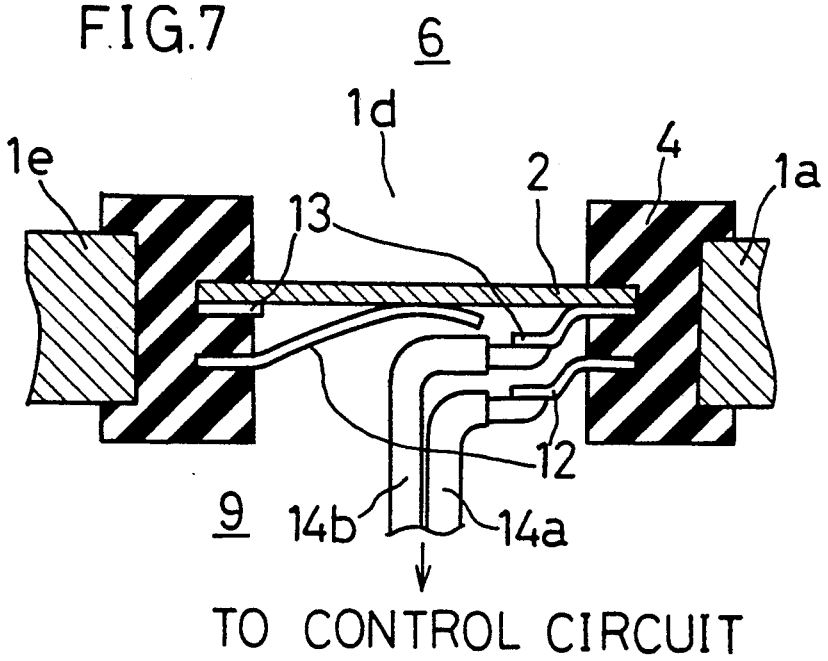
FIG. 7 is an enlarged cross sectional view of a construction around a resonator in the energy converter of the First Preferred Embodiment.
Figure 8:
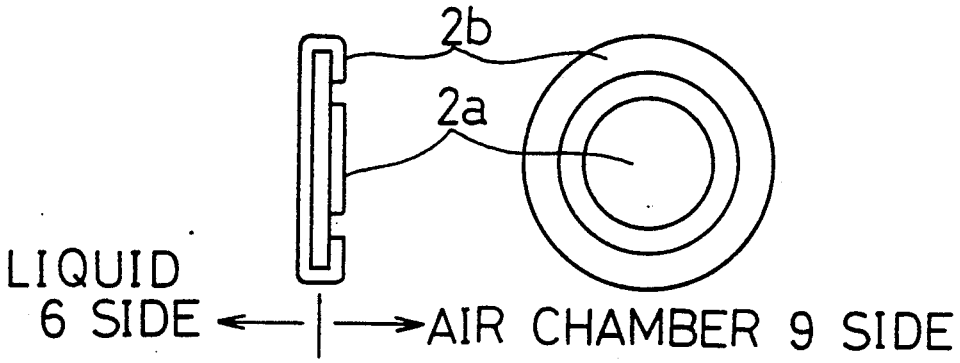
FIG. 8 is a side view and a plan view of the resonator of the energy converter of the First Preferred Embodiment.

FIG. 7 illustrates the construction around the resonator 2 in the energy converter 7. The construction around the resonator 3 has an identical construction, and accordingly it will not be described hereinafter. As illustrated in FIG. 7, the disk-shaped resonator 2 is held with the rubber bushing 4 at the periphery together with a positive electrode 12 and a negative electrode 13. As illustrated in FIG. 8, the resonator 2 includes a negative electrode 2b around the outer periphery on the side of the air chamber 9, and a positive electrode 2a at the substantially central portion on the side of the air chamber 9.

Figure 9:
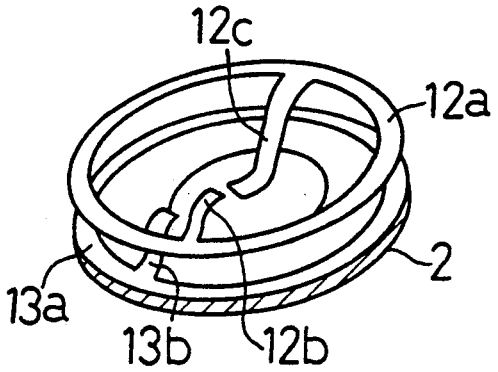
FIG. 9 is a perspective view of the resonator and electrodes of the energy converter of the First Preferred Embodiment.

As illustrated in FIG. 9, the negative electrode 13 includes a ring-shaped portion 13a and a terminal 13b. The ring-shaped portion 13a of the negative electrode 13 contacts the negative electrode 2b of the resonator 2 which is disposed around the outer periphery of the resonator 2. Turning now to FIG. 7, a terminal end of a lead cable 14b is soldered onto the terminal 13b of the negative electrode 13.

Further, as illustrated in FIG. 9, the positive electrode 12 includes a ring-shaped portion 12a, a terminal 12b and a spring-like contact 12c. The ring-shaped portion 12a of the positive electrode 12 is disposed in parallel with the resonator 2 so that they are not brought into contact with each other. The spring-like contact 12c is formed so that it can contact the positive electrode 2a of the resonator 2 which is disposed at the substantially central portion of the resonator 2. Turning now to FIG. 7, a terminal end of a lead cable 14a is soldered onto the terminal 12b of the positive electrode 12.

With the construction thus arranged, the resonator 2 can generate vibrations of high frequencies, and it can be operated to generate a sound wave of a desired high frequency by controlling a voltage and/or an electric current to be applied to the lead cables 14a and 14b.

Figure 10:
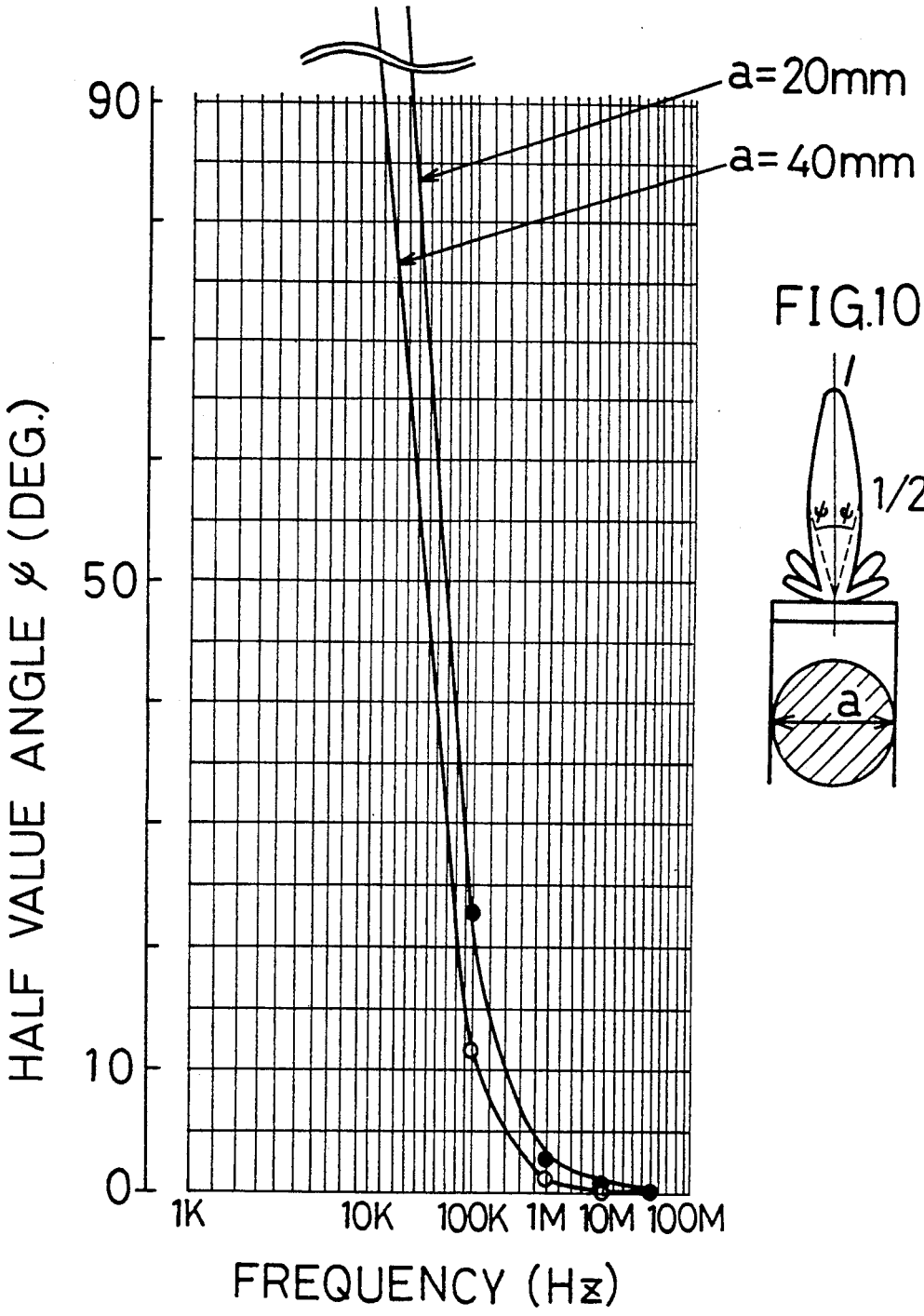
FIG. 10(A) is a schematic illustration of an operation principle of the energy converter according to the present invention.
FIG. 10(B) is a graphic representation of the operation principle of the energy converter according to the present invention.
Figure 10A:
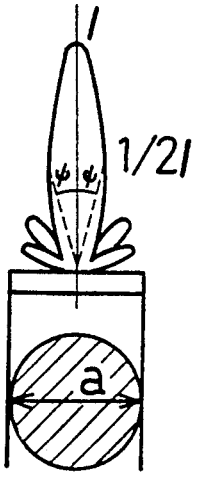

The sound wave caused by the vibrations of the resonator 2 generates the sound field on the side of the resonator 2 contacting the liquid 6 as schematically illustrated in FIG. 10(A). The sound-energy flux density of the sound field extends in the central axis direction of the resonator 2. Actually, the acoustic radiation pressure is as complicated as the sound wave distribution. However, in the case of a disk-shaped resonator having a diameter of 20 mm disposed in a liquid medium, the sound wave caused by the vibrations of the disk-shaped resonator generates the sound field as illustrated in FIG. 10(B). When the frequency of the vibration of the disk-shaped resonator is 1 MHz or more approximately, the sound field exhibits a half value angle of about 2 to 3 degrees or less, and thereby it is formed like a beam. As a result, the sound field can be approximated to a plane progressive wave in actual applications.

Figure 11:
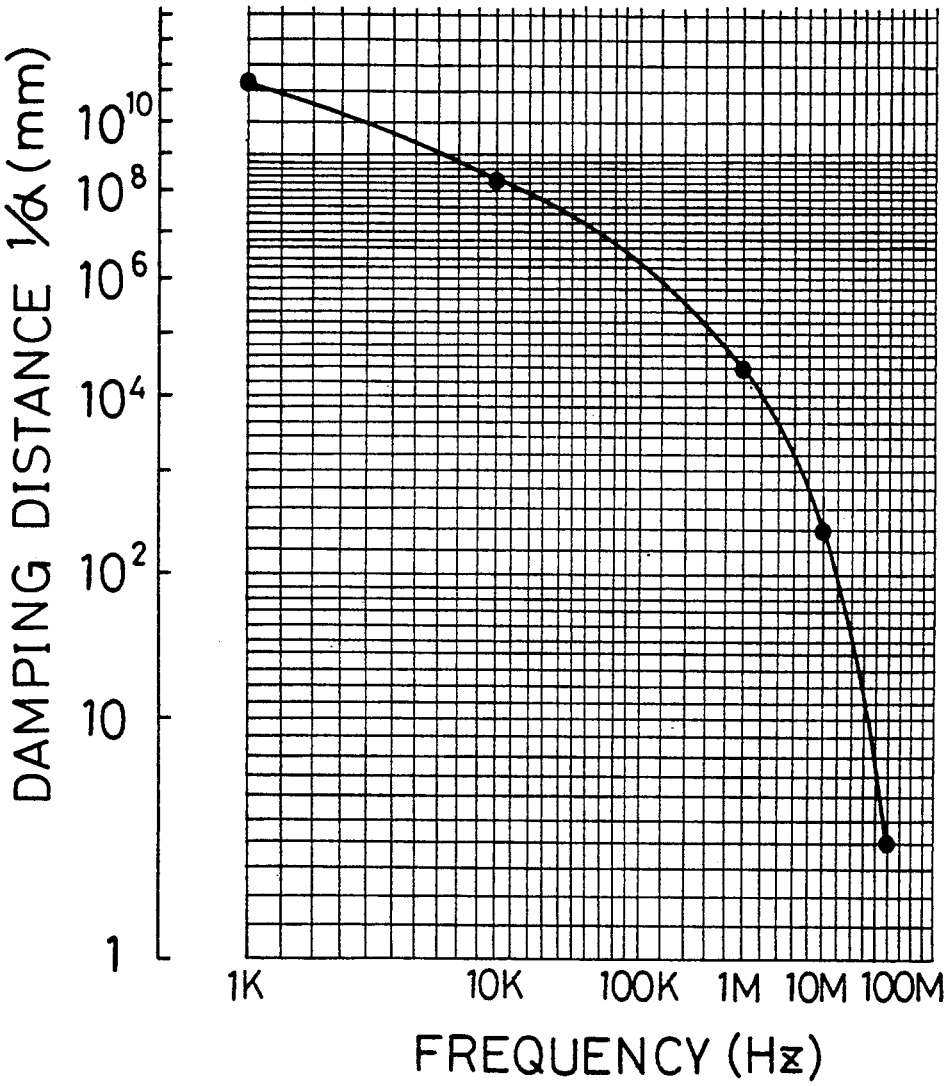
FIG. 11 is another graphic representation of the operation principle of the energy converter according to the present invention.

On the other hand, when the frequency of the vibration of the resonator is high, there arises the damping or loss. As a result, when the frequency of the vibration of the resonator is 10 MHz or more approximately, the damping distance is several tens of centimeters or less in water as illustrated in FIG. 11. Hence, it is preferable to operate or vibrate the resonator in a frequency of 1 to 10 MHz in order to make an energy converter of a few centimeters to several tens of centimeters in size.

Moreover, when a liquid is the radiation medium for the sound wave, it is possible to input a sound power which is larger by three digits than the case where a gas is the radiation medium for the sound wave. For instance, when PZT is used as the resonator, it is possible to input a sound power of about 800 W/cm$^2$ into water, however, it is only possible to input a sound power of as little as about 0.2 W/cm$^2$ into atmosphere. Hence, liquids are suitable for the medium. However, it is not appropriate to employ a liquid, which absorbs or damps the sound wave considerably, for the radiation medium.

In addition, when a liquid is disposed on one side of the resonator and a gas is disposed on another side of the resonator as made in the energy converter 7, almost all of the energy generated by the resonator can be input into the liquid. If such is the case, the electro-acoustic efficiency reaches 90% or more.

As having been detailed so far, in the energy converter of the First Preferred Embodiment, i.e., the energy converter 7, the vibrations of the resonators 2 and 3 are converted into the rotation of the rotor 5 by the acoustic radiation pressure resulting from the progression of the sound wave in the sound field.

Further, the performance of the conventional energy converter, e.g., an ultrasonic motor, depends considerably on the fixation of the resonator, and accordingly it has required extremely accurate adhesion. On the other hand, the energy converter 7 according to the present invention does not require such an extremely accurate adhesion in order to hold the resonators 2 and 3 to the housing 1. As a result, in the manufacture of the energy converter 7, the assembly efficiency of the resonators 2 and 3 is improved remarkably, and, at the same time, the performance stability and the reliability are upgraded sharply.

Furthermore, the energy converter 7 can be used in liquid media to which the conventional energy converter has been hardly applied, and accordingly not only the application fields of the energy converter 7 are widened greatly, but also the cooling efficiency of the energy converter 7 can be expected to improve satisfactorily.

Moreover, according to the operation principle described above, the acoustic radiation pressure arises also in the following directions: e.g., in the progressive directions of the sound waves generated by the resonators 2 and 3 after the reflection, in the progressive directions of the sound waves after the transmittance, in the progressive directions of the sound waves after the absorption and in the progressive directions of the sound waves after the flexure. As a result, a greater designing freedom can be enjoyed fully in the layout arrangement of the rotor 5 or the like.

MODIFIED VERSION OF THE FIRST PREFERRED EMBODIMENT

Figure 3:
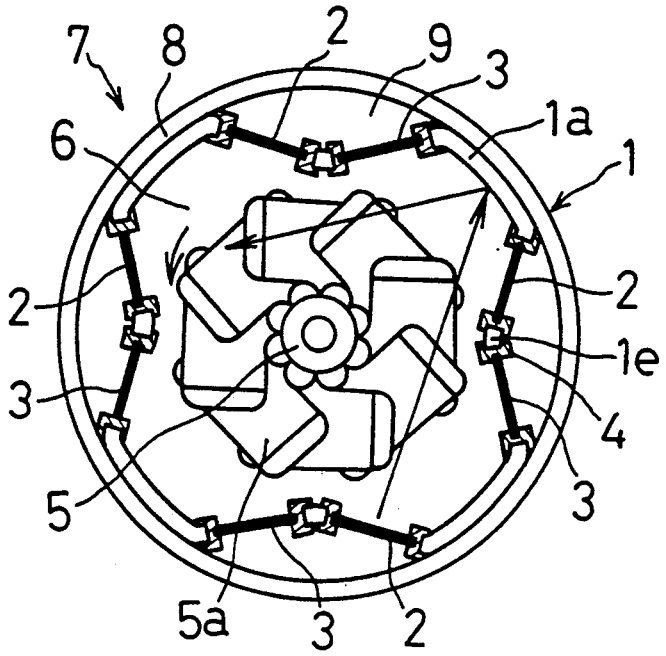
FIG. 3 is a plan view of a modified version of the energy converter of the First Preferred Embodiment.
Figure 4:
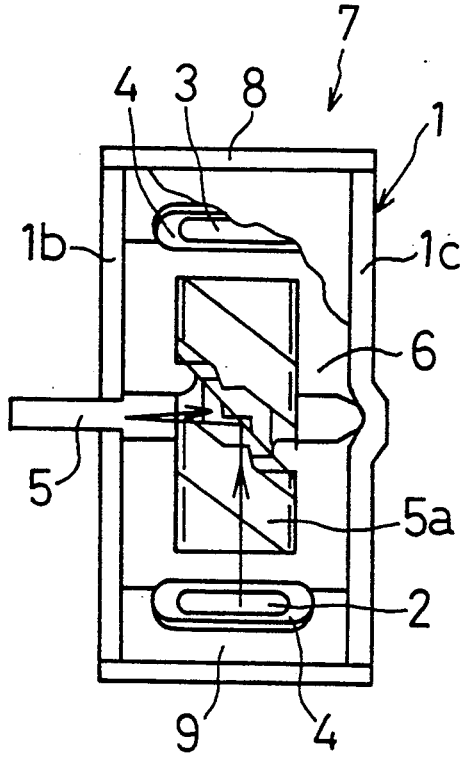
FIG. 4 is a side view of the energy converter illustrated in FIG. 3.

FIGS. 3 and 4 illustrate the modified version of the energy converter of the First Preferred Embodiment. In the modified version of the energy converter 7, the rotor 5 includes a plurality of blades 5*a* which are inclined by 45 degrees with respect to the rotation direction. With this construction, the sound waves which pass over or miss the blades 5*a* can be reflected or directed to the blades 5*a* with the top and the bottom covers 1*b* and 1*c* of the housing 1. As a result, this modified version can exhibit a much more improved energy conversion efficiency than the energy converter 7 of the First Preferred Embodiment does.

Second Preferred Embodiment

Figure 5:
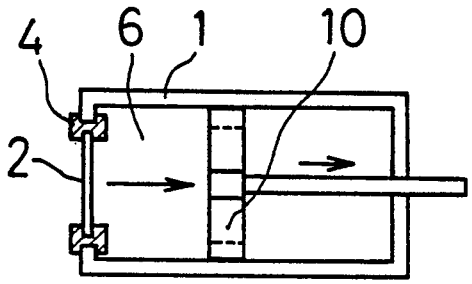
FIG. 5 is a plan view of an energy converter of a Second Preferred Embodiment according to the present invention.

FIG. 5 illustrates the energy converter of the Second Preferred Embodiment. Instead of the rotor 5 of the energy converter 7 of the First Preferred Embodiment, the energy converter of the Second Preferred Embodiment includes a piston 10, and, at the same time, it further includes a housing 1 which accommodates the piston 10 therein, a resonator 2 which is disposed on one side of the housing 1 and a liquid 6 which is filled in the housing 1. Thus, it is an actuator in which the sound wave generated by the vibration of the resonator 2 is converted into the linear movement of the piston 10.

The energy converter of the Second Preferred Embodiment is operated by utilizing the acoustic radiation pressure generating in the progressive direction of the sound wave which is generated by the vibration of the resonator 2. As a result, in the energy converter of the Second Preferred Embodiment, the piston 10 moves only in the direction which is identical with the progressive direction of the sound wave. It goes without saying that the energy converter of the Second Preferred Embodiment provides the same advantageous effects as those of the energy converter 7 of the First Preferred Embodiment.

Modified Version of the Second Preferred Embodiment

Figure 6:
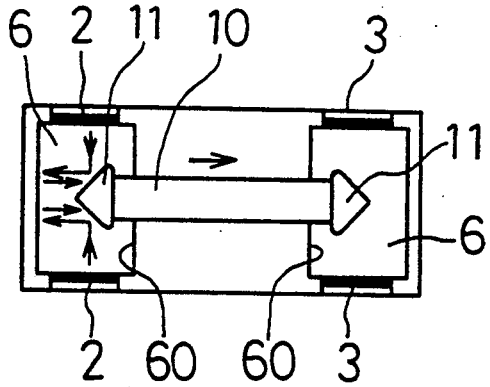
FIG. 6 is a plan view of a modified version of the energy converter of the Second Preferred Embodiment.

FIG. 6 illustrates a modified version of the energy converter of the Second Preferred Embodiment. The modified version of the energy converter of the Second Preferred Embodiment includes a housing 1 which includes a pair of liquid chambers 60, 60 disposed on the both sides, a piston 10 which is disposed in the housing 1 and which includes a pair of cones 11, 11 disposed on the both ends, a pair of resonators 2, 2 which are disposed in one of the liquid chambers 60, 60, a pair of resonators 3, 3 which are disposed in another one of the liquid chambers 60, 60, and a liquid 6 which is filled in the liquid chambers 60, 60.

With this construction, the piston 10 can be operated reciprocatively by selectively operating either the resonators 2 or the resonators 3. It goes without saying that the modified version of the energy converter of the Second Preferred Embodiment provides the same advantageous effects as those of the energy converter 7 of the First Preferred Embodiment.

Having now fully described the present invention, it will be apparent to one of ordinary skill in the art that many changes and modifications can be made thereto without departing from the spirit or scope of the present invention as set forth herein including the appended claims.

What is claimed is:

1. An energy converter, comprising:

a resonator adapter to operate at a range of frequencies at which the resonator generates a sound wave progressing like a beam in a medium; and a rotatable member disposed in a progressive direction of a sound wave generated by said resonator, and adapted for being rotated directly by an acoustic radiation pressure resulting from the progression of said sound wave.

2. An energy converter, comprising a resonator adapted to operate at a range of frequencies at which the resonator generates a sound wave progressing like a beam in a medium;

a movable member disposed in a progressive direction of said sound wave generated by said resonator, and adapted for being driven by an acoustic radiation pressure resulting from the progression of said sound wave, the movable member including an inclining surface which is inclined 45 degrees with respect to said progressive direction of said sound wave; and a reflector adapted for further reflecting said sound wave reflected from the inclining surface of said movable member.

3. An energy converter, comprising:

a resonator adapted to operate at a range of frequencies at which the resonator generates a sound wave progressing like a beam in a medium;

a rotor disposed in a progressive direction of said sound wave generated by said resonator, and adapted for being driven by an acoustic radiation pressure resulting from the progression of said sound wave, the rotor including a blade made of a sound wave reflectible material and disposed in said progressive direction of said sound wave; and a stator to which said resonator is fixed, the stator including a side wall disposed in said progressive direction of said sound wave generated by said resonator, the side wall being adapted for reflecting said sound wave in a direction facilitating a rotation of said rotor.

4. The energy converter according to claim 3, wherein said energy converter further comprises a sealing case which encloses said stator therein.

5. The energy converter according to claim 4, wherein said energy converter further comprises an air chamber which is disposed so as to interpose between said resonator and said sealing case.

6. The energy converter according to claim 3, wherein said rotor includes a plurality of said blades which incline by 45 degrees with respect to said rotation of said rotor.

7. The energy converter according to claim 6, wherein said stator includes a plurality of said side walls, and said energy converter further comprises a plurality of said resonators which is adapted for rotating said rotor in a clockwise direction and a plurality of said resonators which is adapted for rotating said rotor in a counterclockwise direction.

8. An energy converter, comprising;

a resonator adapted to operate at a range of frequencies at which the resonator generates a sound wave progressing like a beam in a medium:

a rotor disposed in a progressive direction of said sound wave generated by said resonator, and adapted for being driven by an acoustic radiation pressure resulting from the progression of said sound wave, the rotor including means disposed in said progressive direction of said sound wave and adapted for receiving said acoustic radiation pressure;

said resonator being adapted for rotating said rotor in a clockwise direction and in a counterclockwise direction.

9. The energy converter according to claim 8, wherein said means of said rotor is a blade made of a sound wave reflectible material.

10. The energy converter according to claim 9, wherein said blade inclines by 45 degrees with respect to a rotation of said rotor.

11. An energy converter, comprising:

a resonator adapted to operate at a range of frequencies at which the resonator generates a sound wave progressing like a beam in a medium; and a movable piston disposed in a progressive direction of said sound wave generated by said resonator, and adapted for being driven by an acoustic radiation pressure resulting from the progression of said sound wave.

12. The energy converter according to claim 11, wherein said piston includes a pair of cones which is disposed on the both ends, and said energy converter further comprises a first pair of said resonators which is adapted for generating said sound wave toward one of the cones and a second pair of said resonators which is adapted for generating said sound wave toward another one of said cones, whereby driving said piston reciprocatively by alternately operating said first and said second pairs of said resonators.

13. The energy converter according to claim 2, wherein said resonator is an ultrasonic resonator.

14. An energy converter, comprising:

a stator;

a resonator held to said stator, and adapted to operate at a range of frequencies at which the resonator generates a sound wave progressing like a beam;

a medium disposed in said stator, and adapted for generating a sound field with said sound wave generated by said resonator; and a movable member disposed in a progressive direction of said sound wave generated by said resonator in said stator, and adapted for being driven in opposite directions by an acoustic radiation pressure resulting from the progression of said sound wave in said sound field generated by said medium.

15. The energy converter according to claim 14, wherein said resonator is an ultrasonic resonator.

16. The energy converter according to claim 14, wherein said energy converter further comprises a sealing case which encloses said stator therein.

17. The energy converter according to claim 16, wherein said energy converter further comprises an air chamber which is disposed so as to interpose between said resonator and said sealing case.

18. An energy converter, comprising:

a stator;

a resonator held to said stator, and adapted to operate at a range of frequencies at which the resonator generates a sound wave progressing like a beam;

a medium disposed in said stator, and adapted for generating a sound field with said sound wave generated by said resonator; and a rotor disposed in a progressive direction of said sound wave generated by said resonator in said stator, and adapted for being driven by an acoustic radiation pressure resulting from the progression of said sound wave in said sound field generated by said medium, the rotor including a plurality of blades made of a sound wave reflectible material.

19. The energy converter according to claim 18, wherein said blades incline by 45 degrees with respect to a rotation of said rotor.

20. The energy converter according to claim 18, wherein said stator includes a plurality of reflectors which is adapted for reflecting said sound wave in a direction facilitating a rotation of the rotor, and said energy converter further comprises a plurality of said resonators which is adapted for rotating said rotor in a clockwise direction and a plurality of said resonators which is adapted for rotating said rotor in a counterclockwise direction.

21. An energy converter, comprising:

a stator;

a pair of resonators held at least to said stator, disposed in a predetermined angular relationship, and adapted to operate at a range of frequencies at which the resonators generate a sound wave progressing like a beam in a medium; and a movable member held movably relative to said stator and including at least a pair of surfaces, the surfaces being disposed in a progressive direction of said sound wave and being adapted for receiving an acoustic radiation pressure resulting from the progression of said sound wave, said movable member being adapted to be driven in opposite directions when the surfaces receive acoustic radiation pressure.

22. An energy converter, comprising:

a resonator adapted to operate at a range of frequencies at which the resonator generates a sound wave progressing like a beam in a medium; and a movable member disposed in a progressive direction of said sound wave generated by said resonator, and adapted for being driven by an acoustic radiation pressure resulting from the progression of said sound wave, the movable member being adapted for being driven in opposite directions by the acoustic radiation pressure.

23. The energy converter according to claim 3, wherein said resonator is an ultrasonic resonator.

24. The energy converter according to claim 8, wherein said resonator is an ultrasonic resonator.

25. The energy converter according to claim 11, wherein said resonator is an ultrasonic resonator.

26. The energy converter according to claim 22, wherein said resonator is an ultrasonic resonator.

* * * * *